US008993944B2

(12) United States Patent
Adams et al.

(10) Patent No.: US 8,993,944 B2
(45) Date of Patent: Mar. 31, 2015

(54) MICROWAVEABLE PACKAGING FOR FOOD PRODUCTS INCLUDING A FROZEN COMPONENT

(75) Inventors: Animequom Adams, Harbor Springs, MI (US); Hunter Gartner, Northville, MI (US); John Partridge, East Lansing, MI (US); Janice Harte, Bath, MI (US); Keith Emery, Kentwood, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 645 days.

(21) Appl. No.: 13/372,343

(22) Filed: Feb. 13, 2012

(65) Prior Publication Data

US 2012/0205366 A1 Aug. 16, 2012

Related U.S. Application Data

(60) Provisional application No. 61/442,594, filed on Feb. 14, 2011.

(51) Int. Cl.

| | |
|---|---|
| ***H05B 6/80*** | (2006.01) |
| ***B65D 85/78*** | (2006.01) |
| ***H05B 6/64*** | (2006.01) |

(52) U.S. Cl.

CPC ..... *H05B 6/6408* (2013.01)
USPC ..... 219/730; 219/729; 426/107

(58) Field of Classification Search

CPC ..... H05B 6/6408
USPC ..... 219/725–730, 732, 762, 759; 426/76, 426/103, 107, 109, 110, 118, 241, 243, 426/234; 99/DIG. 14

See application file for complete search history.

(56) References Cited

U.S. PATENT DOCUMENTS

| | | | | |
|---|---|---|---|---|
| 3,302,632 | A | | 2/1967 | Fichtner |
| 4,020,310 | A | | 4/1977 | Souder, Jr. et al. |
| 4,233,325 | A | | 11/1980 | Slangan et al. |
| 4,574,174 | A | | 3/1986 | McGonigle |
| 4,874,618 | A | * | 10/1989 | Seaborne et al. ..... 426/76 |
| 4,926,020 | A | | 5/1990 | Atwell et al. |
| 4,962,293 | A | | 10/1990 | Lackey |
| 5,006,684 | A | | 4/1991 | Wendt et al. |
| 5,185,506 | A | | 2/1993 | Walters |
| 5,254,821 | A | | 10/1993 | Walters |

(Continued)

OTHER PUBLICATIONS

Ryynanen, Suvi, "Microwave Heating Uniformity of Multicomponent Prepared Foods", 2002, 86 pages, EKT Series 1260, University of Helsinki, Department of food Technology (Dissertation).

*Primary Examiner* — Quang Van

(74) *Attorney, Agent, or Firm* — Howard & Howard Attorneys PLLC

(57) ABSTRACT

Packaging and a dessert food product combines a hot portion and a cold portion. In one embodiment, the dessert combines hot pie with a topping of ice cream in a single package. In one aspect of the invention, the microwaveable food product and package incorporates a food package that simultaneously includes various susceptor films that allow for differential heating of food. The susceptor film(s) shield the cold-portion food products from being heated in the microwave while they provide even heating of the hot portion of the product. The packaging provides a quick, convenient and tasty dessert with minimal effort. In another aspect of the present invention, the pie and ice cream formulation has been optimized to maintain superior flavor and texture properties after freezing and microwave reheating.

22 Claims, 13 Drawing Sheets

(56) References Cited

U.S. PATENT DOCUMENTS

| | | | | |
|---|---|---|---|---|
| 5,256,846 | A | 10/1993 | Walters | |
| 5,300,746 | A | 4/1994 | Walters et al. | |
| 5,428,209 | A | 6/1995 | Babu et al. | |
| 5,718,370 | A | 2/1998 | Lafferty et al. | |
| 6,204,492 | B1 | 3/2001 | Zeng et al. | |
| 6,627,862 | B1 | 9/2003 | Pedersen | |
| 6,903,320 | B2 | 6/2005 | Cutler et al. | |
| 7,019,271 | B2 | 3/2006 | Wnek et al. | |
| 7,476,830 | B2 * | 1/2009 | Middleton et al. | 219/729 |
| 7,777,164 | B2 | 8/2010 | Ly | |
| 7,851,730 | B2 | 12/2010 | Carmichael et al. | |
| 7,851,731 | B2 | 12/2010 | Ly | |
| 7,868,274 | B2 | 1/2011 | Bohme et al. | |
| 2004/0058038 | A1 * | 3/2004 | Lee | 426/107 |
| 2009/0039076 | A1 | 2/2009 | Maslowski et al. | |

* cited by examiner

MICROWAVEABLE PACKAGING FOR FOOD PRODUCTS INCLUDING A FROZEN COMPONENT

CROSS-REFERENCE TO RELATED APPLICATIONS

The present application claims priority to U.S. Provisional Patent Application Ser. No. 61/442,594, filed Feb. 14, 2011, the entire specification is expressly incorporated herein by reference.

FIELD OF THE INVENTION

The present invention relates generally to microwaveable food products, and more particularly, to microwaveable packaging for food products which include two or more components, at least one of which is to remain frozen.

BACKGROUND OF THE INVENTION

Microwaves are a form of electromagnetic radiation, characterized by frequency. Most microwave ovens operate at a frequency of 2,450 million cycles per second (2450 MHz). Energy is delivered in the form of an orthogonal wave, with electrical and magnetic components. Microwaves in a microwave oven are generated by means of a magnetron. The waves scatter in all directions inside the oven cavity to food placed in the cavity. The walls of a microwave are usually coated to reflect microwaves. Most ovens, in an attempt to distribute the waves evenly, have a fan which reflects the radiation randomly and a turn table which rotates the food.

In microwave ovens, food is placed on the turn table and heat is generated by the application of the microwaves to the ingredients of the food and sometimes even the packaging itself. The varying electric field of microwaves is responsible for most of the heating of food in microwave ovens, since the food does not interact with the magnetic field. The ions in the food and the water in the air of the microwave oven are accelerated by the electric field, thus giving kinetic energy to the ions, and converting that kinetic energy to heat. The higher the frequency range of the microwave oven increases the penetration depth of the microwaves into the food, and thus heating faster. Due to undesirable field distribution, microwaves hitting the sidewalls of a food container, and differences in penetration depth in different foods, it is not uncommon to see the center of a food item unacceptable colder than the outlying edges.

Consumers of frozen foods are often looking for convenience, value, and durability. Multiple food items in a microwavable entrée typically are limited to selections of food items that heat at similar rates to reach a singular temperature amongst all food items in the same amount of time.

However, some food products with multiple food items do not lend themselves to being heated at the same or similar rates. For example, pie à la mode contains a product meant to be served frozen and a food product meant to be served hot. Particularly, frozen desserts are not typically heated by microwave energy, as they are meant to be served at lower temperatures. There is a need to provide a solution where various types of food items that use the concept of undesirable field distribution, so that frozen food items can be kept in the frozen state while other food items are heated by microwave energy. The present invention is aimed at one or more of the problems identified above.

SUMMARY OF THE INVENTION

In one aspect of the present invention, a microwave energy interactive food packaging apparatus for use during microwave cooking of a food product is provided. The food packaging apparatus may include a first food compartment and a second food compartment. Each having a cavity being capable of containing at least one food item. The microwave energy interactive food packaging apparatus may be used with a food product having a first food portion, meant to be served cold or frozen, and a second food portion meant to be served hot. This is accomplished by the first food compartment having at least one layer of: non-stick interior material, insulant material capable of insulating the first food portion from heat resulting from microwave energy, and a susceptor material or film(s) for reflecting microwave energy away from the first food portion. The second food compartment cavity is adapted to receive the first food compartment. A second interior surface and the first exterior surface of the first food compartment form a sub cavity within the second food compartment cavity. The first exterior surface and the second interior surface are adapted to reflect microwave energy into the sub cavity. The shape of the first food compartment may be that of a cup, and the shape of the second food compartment may be that of a bowl. In another embodiment, the food compartments could be cylinders.

The microwave energy interactive food packaging apparatus for use during microwave cooking of a food product may be individually sealed by a wrap or in a pouch.

Alternatively, the second food compartment may have an upper lip. A wrap can be affixed to the second food compartment at the upper lip.

In an embodiment, the first food compartment may be dimensionally taller than the second food compartment. This allows microwave energy to reflect onto the top layer of the second food item.

BRIEF DESCRIPTION OF THE DRAWINGS

So that those having ordinary skill in the art to which at least some embodiments of the invention pertains will more readily understand how to make and use systems, devices and methods in accordance therewith, such embodiments thereof will be described in enabling detail herein below with reference to the drawings. It should be noted that the drawings are not necessarily drawn to scale and certain figures may be shown in other form for illustrative reasons.

DETAILED DESCRIPTION OF INVENTION

The following description contains illustrations of devices, systems and methods according to the invention for purposes of promoting an understanding of embodiments the invention, among other things. It should be understood that the scope of the invention is not limited by these embodiments. Alterations and modifications of the features of the invention, as well as, additional applications of its principles in other forms or embodiments, such as those which would normally occur to one skilled in the relevant art having possession of this disclosure, are to be considered within the scope of the invention. With reference to the drawings, and in operation, the present invention provides an apparatus and process to be used with microwave oven cooking. Preferably, the molded containers of the present invention are formed from a plastic such as polyethylene terephthalate or any high temperature specialty resins that will withstand the high temperatures created by susceptor surfaces when subject to microwave energy.

Figure 1:
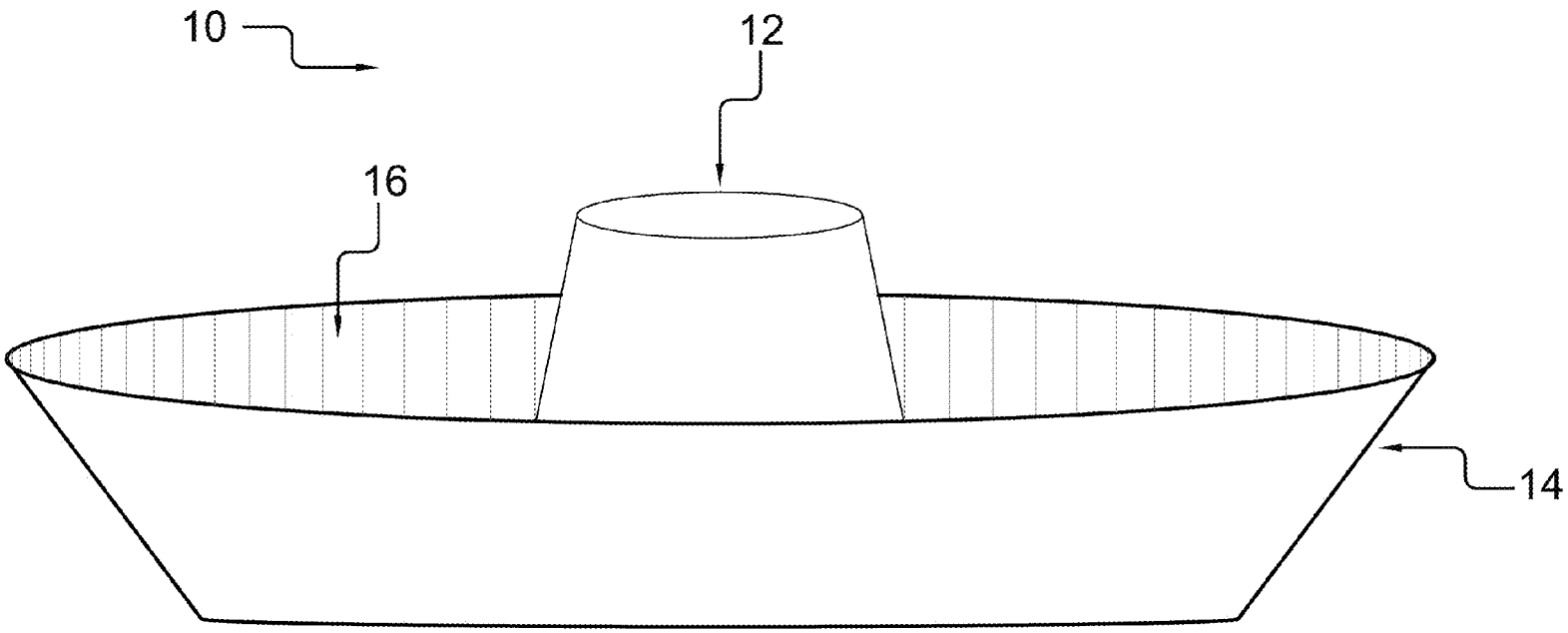
FIG. 1 is a perspective view of a microwaveable structure for two food items, according to an embodiment of the present invention.

With reference to FIG. 1, and in operation, the present invention provides a food packaging structure 10. The food packaging structure 10 is microwaveable and is used for packaging at least two food items (not shown in this figure). The food packaging structure 10 is resistant to softening, scorching, combusting, or degrading at typical microwave oven heating temperatures, for example, at from about 250° F. to 425° F. The food packaging structure 10 is envisioned to be compatible from an organoleptic, chemical, and toxicity standpoint.

In the illustrated embodiment, the food packaging structure 10 includes a first food compartment 12 and a second food compartment 14. Each compartment is capable of holding at least one type of food. The illustrated food packaging structure 10 is in the shape of a hollowed out cylinder with the first food compartment 12 being a hollowed out cone in its center. In another embodiment, the food compartments 12, 14 could be various other shapes, including, for example, without limitation: a bowl, a cup, etc. The shape should be understood to be determined by the portion size of the food item being heated, and different packaging combinations are contemplated. Each food compartment has a cavity that allows the compartment to completely surround the food products on all but the top layer of the food products. In the illustrated embodiment of FIG. 1, the first food compartment 12 is taller in dimension than the second food compartment 14. In another embodiment, the first food compartment 12 could be dimensionally level with the second food compartment 14.

Figure 2:
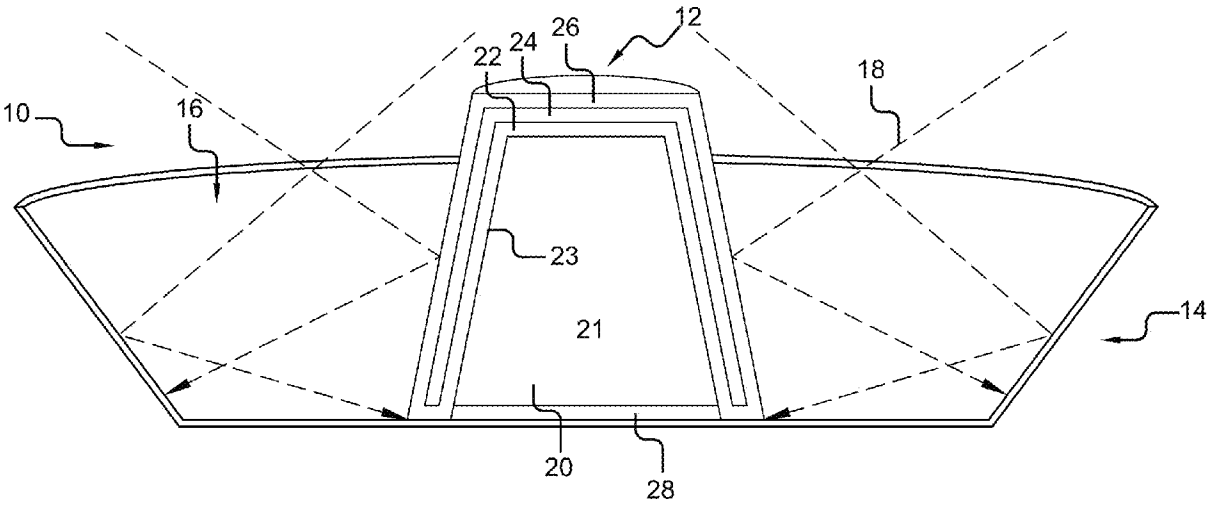
FIG. 2 is a cross-sectional view of the microwaveable structure of FIG. 1.
Figure 2A:
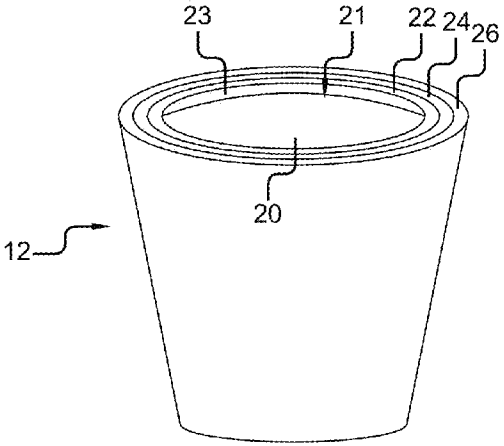
FIG. 2*a* is a second view of the microwaveable structure first food compartment of FIG. 1.

Referring to FIGS. 2 and 2*a*, in one embodiment, a first food item 20 is meant to be kept cold or frozen and is inserted into a cavity 21, so that the first food item 20 can be shielded and remain at its frozen temperature during microwave cooking. In the illustrated embodiment, the first food compartment 12 is made up of three layers: an inner layer 22, a median layer 24, and an exterior layer 26. The inner layer 23 of the first food compartment 12 may have a non-stick surface 23. The non-stick property of the non-stick surface 23 can be obtained by any means know in the art, such as: being a material having non-stick property or a non-stick surface that is sprayed, coated, flaked, or powdered onto the inner layer 22 to make it non-stick. The median layer 24 of the first food compartment 12 is meant to shield the frozen first food item 20 from the heat generated from a microwave 18 (represented by dashed lines).

In one embodiment, the median layer 24 could be an absorbent layer meant to prevent the penetration of the microwave 18. In another embodiment, the median layer 24 could be, or include, an insulating material bonded to the other layers. In another embodiment, the median layer 24 could be bonded by any means known in the art such as: welded, adhesively bonding, coated, flaked, or powered onto the inner layer 22, much like the non-stick surface 23. The median layer 24 may be formed to comprise various configurations, depending on a particular application. The insulating material may include both microwave energy responsive or interactive components, and microwave energy transparent or inactive components. As way of non-limiting example, in one embodiment, shielding elements could be appropriately spaced in the layer to allow microwave energy to specific areas of the first food item 20. If desired, multiple layers of insulating material may be used to enhance the insulating properties of the median layer 24.

Referring to FIG. 2, in another embodiment, the second food compartment 14 may include a supplemental layer 28 in the center of the food structure 10, where the first food compartment 12 rests. The supplemental layer 28 may create a lip in the center of the second food compartment 14 so the inner layer 22 fits into the lip and completely seals the top of the first food compartment 12. In another embodiment, the supplemental layer 28 could be made of insulant material. The purpose of which would be so that the first food item 20 is shielded from the heat generated from the microwave energy distributed across the second food compartment 14. This configuration creates an additional layer of shielding so that the first food item 20 situated inside the first food compartment 12 does not melt or raise in temperature.

In the main embodiment shown in FIG. 2, an exterior layer 26 of the first food compartment 12 can be a reflective. The exterior layer 26 is meant to reflect the microwaves 18 back onto the food. The second food compartment 14 has the interior layer 16 that can reflect or transmit microwaves 18 toward or away from a particular area of a second food item 32. In the main embodiment, the material that makes up second food compartment 14 must be able to withstand microwave energy 18 and the heat created by the microwaves 18. In another embodiment, the interior layer 16 and the exterior layer 26 may be made from or include, a susceptor film or susceptor material. A susceptor film absorbs the microwaves which would ordinary penetrate the packaging and convert it to heat. The film or material can be formed by any known method to one skilled in the art. The process raises the exterior layer temperatures to levels where it can heat food by conduction. Susceptors can be formed by any means known in the art, such as: from a substrate upon which a coating for absorption of microwave radiation is deposited, printed, extruded, sputtered, evaporated, or laminated.

Susceptor films may include a pattern 33 that is specific for a particular food item in order to heat the food item evenly. Various patterns include, but are not limited to square matrix, shower flower, hexagonal, slot matrix, and/or concentric circles (see FIG. 3). In this embodiment, the medium layer 24 is an insulant layer so as to maintain the temperature of the frozen food item 20, while the exterior layer 26 is increasing in temperature.

Figure 3:
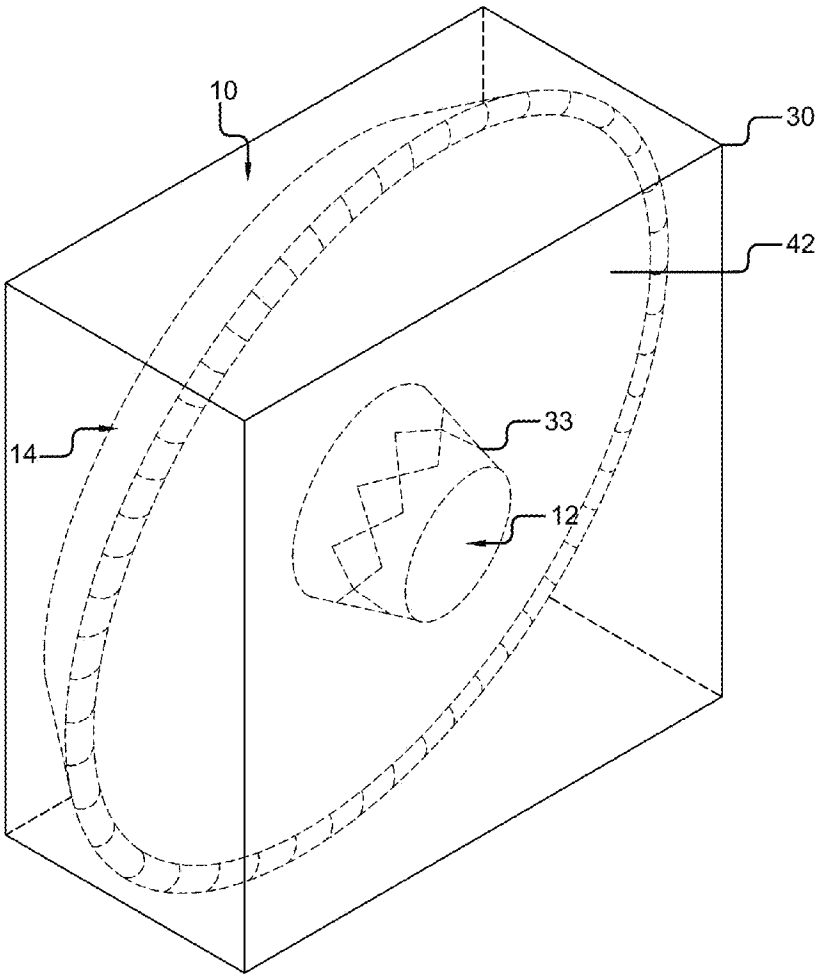
FIG. 3 is a perspective view of the food packaging, according to an embodiment of the present invention.

Referring to FIG. 3, in the illustrated embodiment, the food packaging structure 10 is shown further packaged in a box 30. The box 30 shape can be configured differently in various embodiments. The food packaging structure 10 is shown in the exemplary embodiment with the second food item 32 being a 5 inch diameter apple pie and the first food compartment 12 being conical shaped in the center containing ice cream. In the illustrated embodiment, susceptor X pattern 33 is added to first food compartment 12. The food packaging structure 10 is protected with an outer wrap 34, further detailed in FIG. 4.

Figure 4:
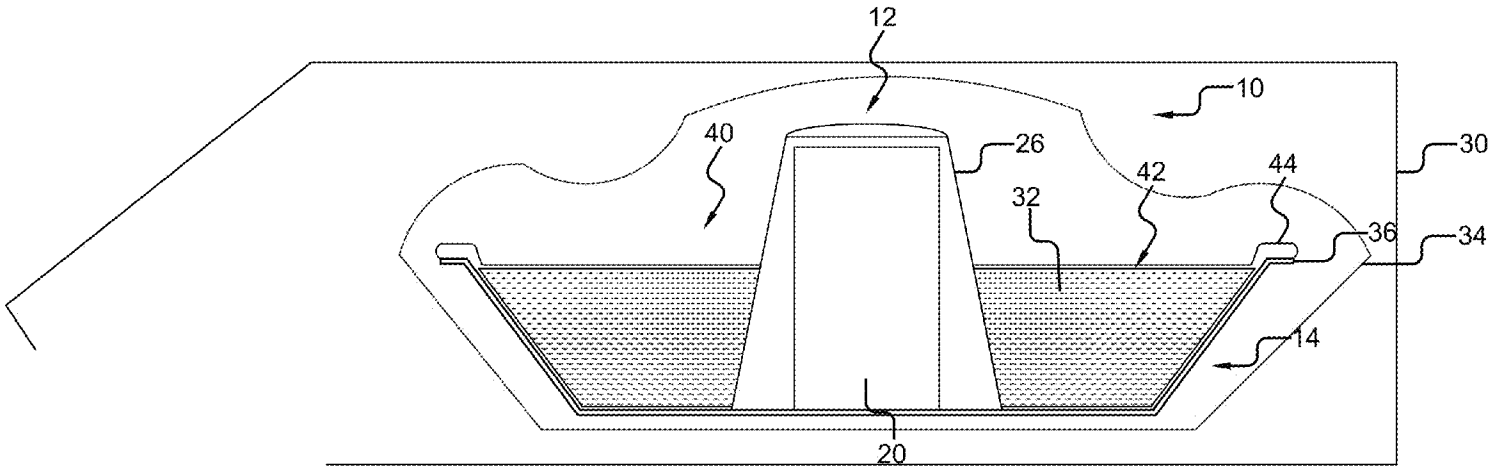
FIG. 4 is a cross-sectional view of the food packaging, according to an embodiment of the present invention.

Referring to FIG. 4, the outer wrap 34 meant to protect and preserve the contents from outside environmental effects, microorganisms, dust, water, etc. In the embodiment shown, the outer wrap 34 completely envelopes food packaging structure 10 by way of a pouch. In another embodiment, the outer wrap 34 could seal only the food compartments at the lip 36 of the second food compartment 14. The food packaging structure 10 is further packaged with the box 30 as an additional protection against outside environmental effects, and displays logos and nutritional value. In the illustrated embodiment, the box 30 opens at the top so that the food packaging structure 10 may be removed from the interior of the box 30.

Figure 5:
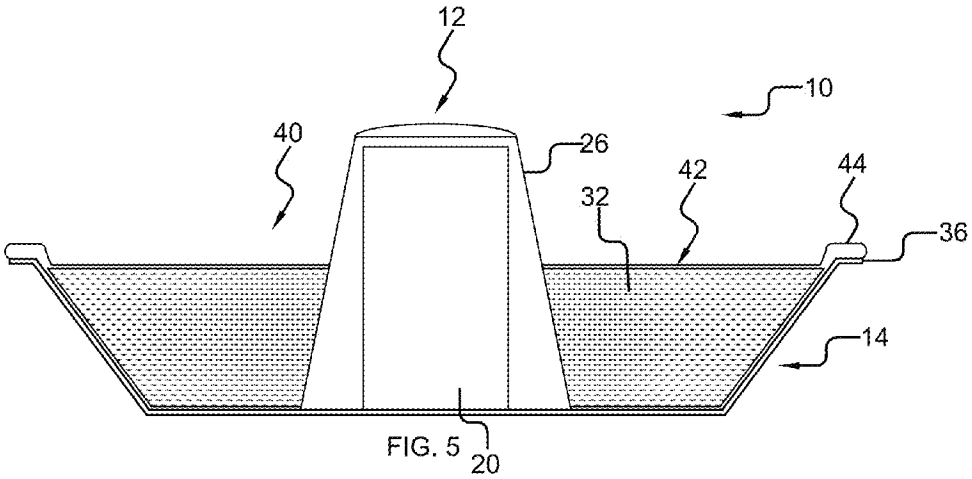
FIG. 5 is a cross-sectional view of the two food products and the microwave structure.

In the embodiment of FIG. 5, the first food compartment 12 and the second food compartment 14 create two zones in which one food product will maintain its cold temperature while another zone food product is heated up. The first zone is cavity 21 of first food compartment 12, and the second zone is the cavity created by the exterior 26 of first food compartment 12 and the interior 16 of the second food compartment 14. The food structure 10 is placed in a microwave oven, in which it is desirable to heat or cook in substantially the same amount of time the second food item 32 while keeping the first item 20 in its cold or frozen state. Though not being bound by this theory, in the exemplary embodiment, food packaging structure 10 uses the principal of uneven distribution by placing the first food compartment 12 in the center of the second food compartment 14.

In the embodiment shown in FIG. 5, the first food compartment 12 is shown dimensionally taller than the second food compartment 14, and the exterior layer 26 is a susceptor. An air gap 40 is formed between the exterior layer 26 and the top surface 42 of the second food item 32. Heat gives off infrared radiation, the higher the heat the more infrared radiation. The air gap 40 is a poor thermal contact for the food and the susceptor pattern 33 or exterior surface 26, which in turn means that the susceptor pattern 33 or exterior layer 26 will heat to a higher temperature, thus increasing the infrared radiation. The emitted infrared radiation comes into contact with the top layer of second food item 32 and browns the surface of the top layer due to the penetration depth of infrared radiation being less than microwaves. In the exemplary embodiment, "Minute Escape Apple Pie à la mode", this infrared radiation will brown the top surface 42 and pie crust 44.

INDUSTRIAL APPLICABLE

Figure 6:
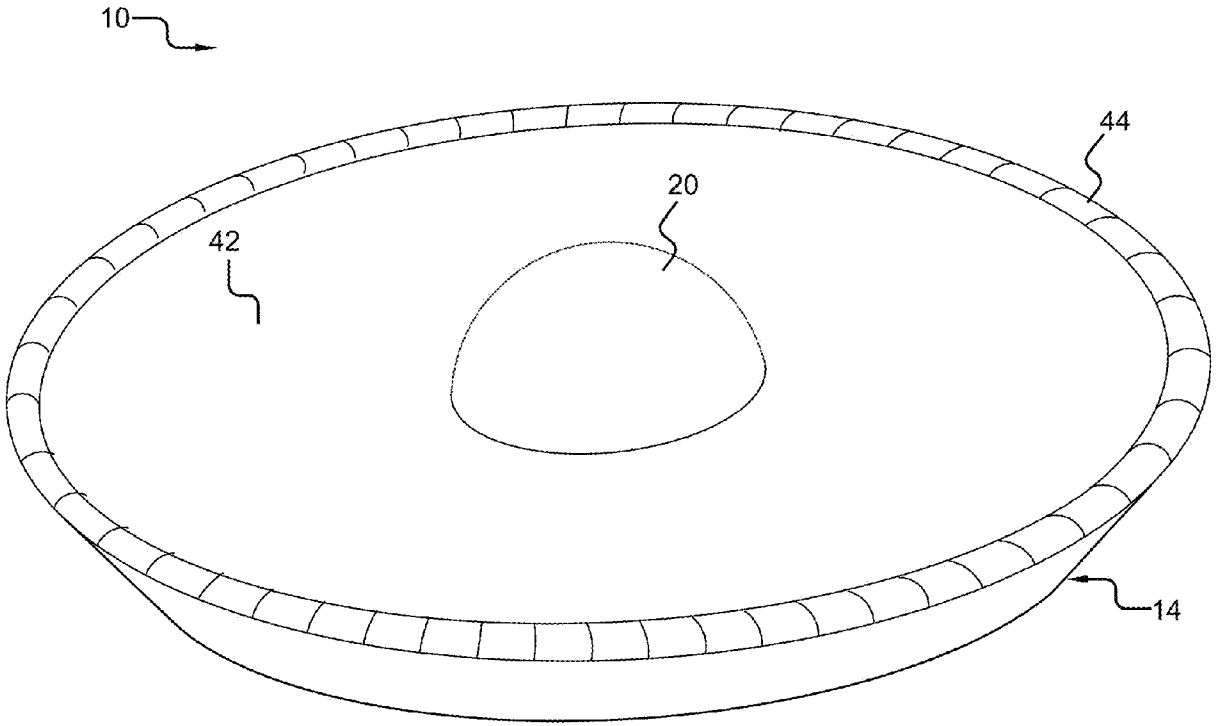
FIG. 6 is a perspective view of the microwaveable structure in an exemplary embodiment of the present invention, apple pie à la mode (ice cream).

Referring to FIG. 6, the exemplary embodiment, "Minute Escape Apple Pie à la mode" is shown. The food product, "Minute Escape Apple Pie à la mode" is a personal 5-inch pie that has the traditional 2.1 oz. flaky crust; a 2.3 oz. of hot, rich pie filling made with real apple chunks and cinnamon; sprinkled crumbly oatmeal crisps on top of the filling; topped with an icy cold custard ice cream; and cooked with the speed for the modern busy lifestyle. In this embodiment, the first food item 20 is ice cream. The second food item 32 is an apple pie with streusel pie crust 44. The first food compartment 12 has been removed from the food package structure 10 leaving only the ice cream food product in the center of the pie. The non-stick properties of the non-stick surface 23 allow the ice cream to be deposited in the center of the pie once the first food compartment 12 is removed. In the preferred embodiment, the streusel (which makes up the top of the second food item 42) and pie crust 44 is browned after introduction to microwaves 18.

When formulating the exemplary embodiment, "Minute Escape Apple Pie à la Mode", there were many technological challenges to overcome in creating the structure and process for this food product including: 1) reducing the time needed to heat the pie; 2) browning the top surface of the pie; and 3) maintaining the temperature of the ice cream while heating the pie filling. Heat transfer rates of the apple filling and prevention of the formation of ice crystals also play important roles in the time required to heat the pie.

So to reduce the time needed to heat the pie, specific heat of the apple pie filling was firstly reviewed. The apple filling component of the pie was viewed as a homogenous mass with an overall specific heat capacity. Therefore, lowering the total specific heat capacity would reduce the amount of energy and time needed for adequate heating, while preserving the rich taste and texture. This is done by selecting food ingredients with lower specific heat capacities and using them to lower the overall specific heat capacity of the apple filling. The addition of sugars and glycerol to the apple filling formulation will help to lower the specific heat capacity, therefore decreasing the amount of energy need to raise the temperature of the filling.

In order to evaluate the effect of sucrose and corn syrup concentrations on the pie filling heating rates, two apple filling formulations were tested using CALSoft™ heat penetration software. The final filling formulation was compared to a formulation containing 50% less sucrose and corn syrup (See Table 1).

TABLE 1

Final filling formulation and reduced sugar formulation

| Ingredient | Final Filling Weights (g) | % | Reduced Sugar Weights (g) | % |
|---|---|---|---|---|
| Apples (Frozen) | 100 | 54.30% | 100 | 64.90% |
| Modified Food Starch (Novation 4300) | 3 | 1.60% | 3 | 1.90% |
| Brown Sugar | 20 | 10.90% | 20 | 13.00% |
| Granulated Sugar | 20 | 10.90% | 10 | 13.00% |
| Corn Syrup | 40 | 21.70% | 20 | 25.90% |
| Cinnamon | 0.8 | 0.40% | 0.8 | 0.50% |
| Alginate gum (TIC 400) | 0.4 | 0.20% | 0.4 | 0.30% |
| Total | 184.2 | 100 | 154.2 | 100 |

Fillings were blended to ensure homogeneity, and 60 g were measured into I-CHEM™ septum jars. Thermocouple probes were placed into the center of the jars through the septum, frozen, and held at 0° F. overnight. The jars were heated at 180° F. in a water bath. Temperature values were read at 10 seconds intervals for 10 minutes.

Figure 7:
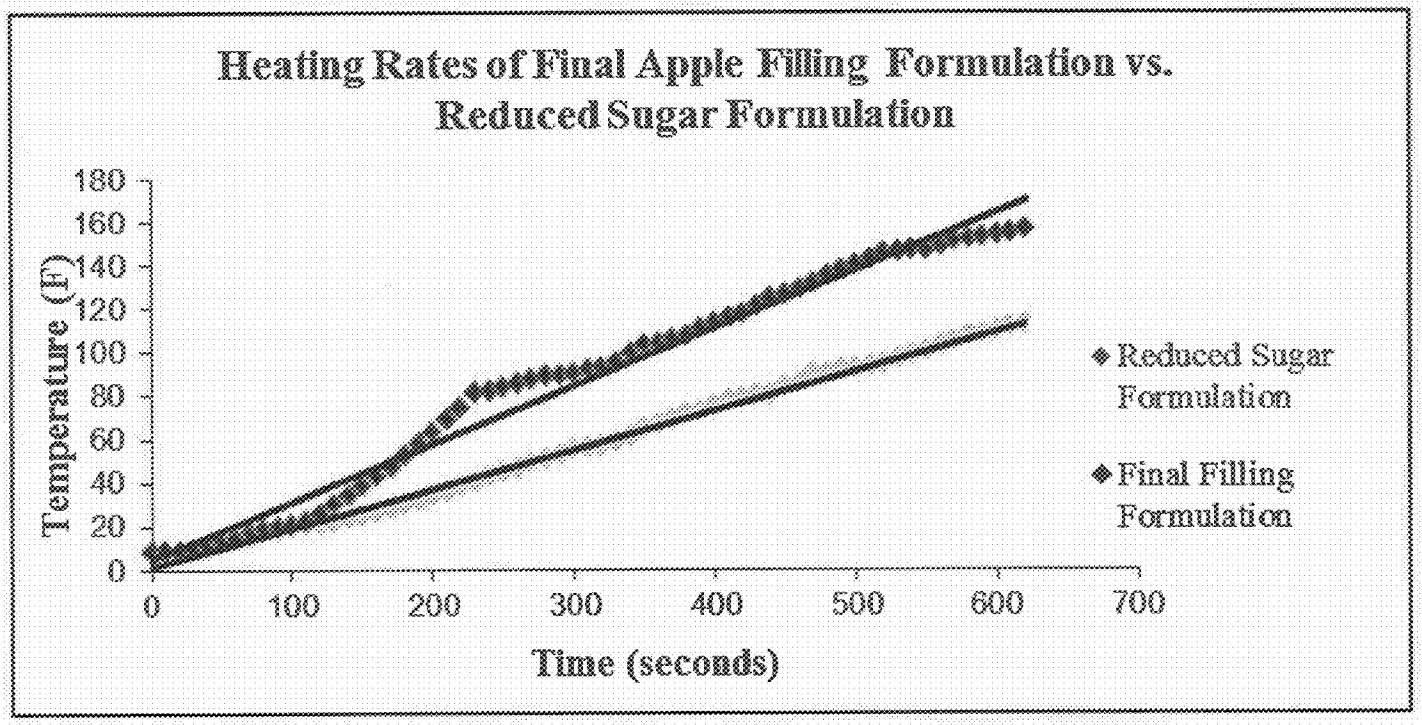
FIG. 7 is a graph of the Heating Rate of Final Apple Filling Formulation vs. Reduced Sugar Formulation.

FIG. 7 shows that the concentration of sugar and corn syrup in the final filling formulation successfully increased the overall heating rate of the apple filling. Over a period of ten minutes, the final filling formulation reached 160° F., while the 50% reduced sucrose and corn syrup formulation reached 110° F. By lowering the specific heat of the filling with sucrose and corn syrup, a faster heating rate was achieved.

Two ingredients were eliminated from earlier formulations after testing: methocel gums and glycerol. Since methocel gums (K4M, DOW Chemical Company) increase viscosity at elevated temperatures, they are intended for baked pies to prevent "boiling out" of the filling during baking. This was compensated by in the pie production and assembly, by making all of the pie components are heated and baked separately. Therefore, the advantage of Methocel did not add significant benefits for processing and microwave heating. The intent of adding the glycerol was to increase the heating rate of the filling because of a low specific heat (2.43 kJ/kg/K at 25° C.) compared to water (4.18 kJ/kg/K at 25° C.). Experiments were conducted to verify this. The glycerol formulation was tested against the final filling formulation. It was determined that the glycerol did not increase the heating rate significantly. By proving that the methocel and glycerol did not improve the overall functionality of the pie, these were removed from the final formulation. The final filling formulation was compared to a formulation containing glycerol (See Table 2).

TABLE 2

Apple filling formulation with glycerol

| Ingredient | Amount (g) | % |
|---|---|---|
| Apples (Frozen) | 100 | 50.2% |
| Modified Food Starch (Novation 4300) | 3 | 1.5% |
| Brown Sugar | 20 | 10.0% |
| Granulated Sugar | 20 | 10.0% |
| Corn Syrup | 40 | 20.1% |
| Glycerol | 15 | 7.5% |
| Cinnamon | 0.8 | 0.4% |
| Alginate gum (TIC 400) | 0.4 | 0.2% |
| Total | 199.2 | 100.0% |

Figure 8:
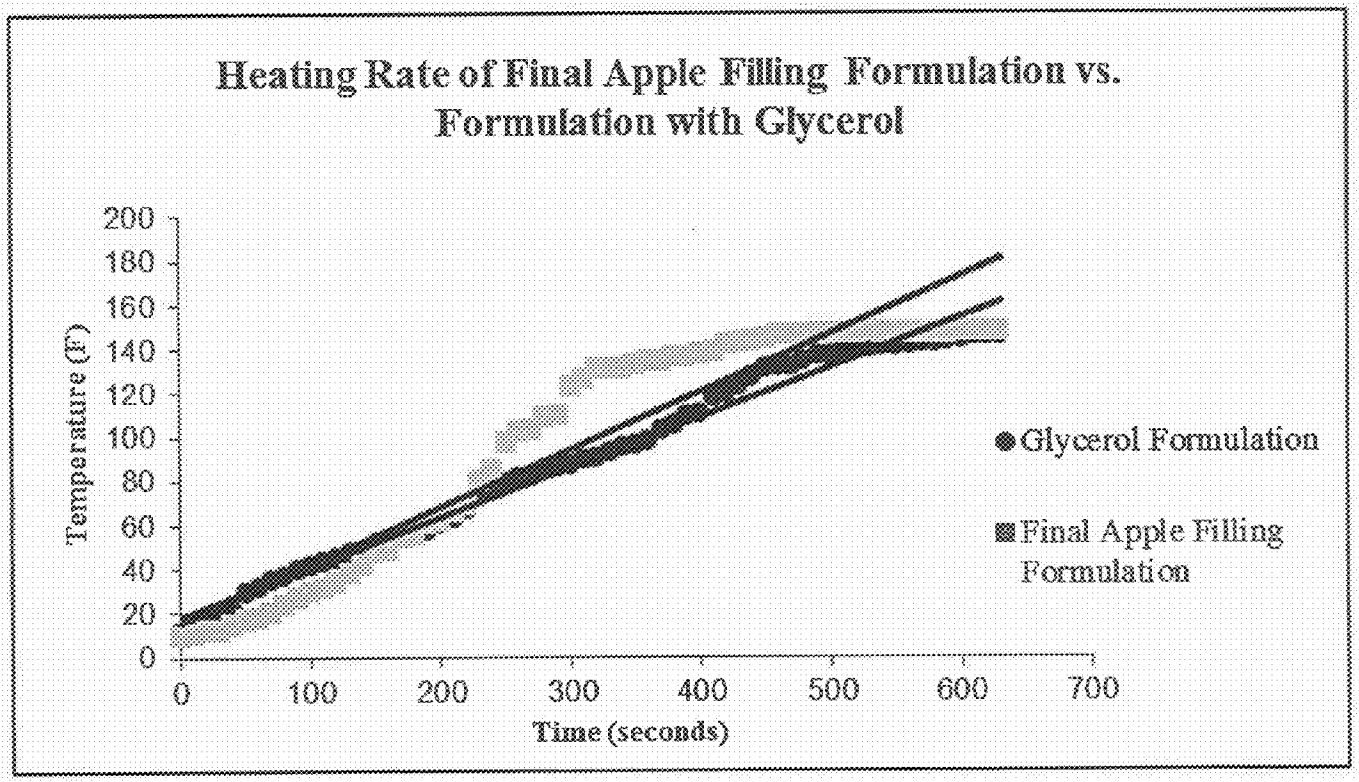
FIG. 8 is a graph of the Heating Rate of Final Apple Pie Filling Formulation vs. Formulation With Glycerol.

Over a period of ten minutes, the heating rates are the same. It was concluded that glycerol is not beneficial in achieving a faster heating rate. Therefore, glycerol was omitted from the apple filling based on these results. FIG. 8 displays the results of the final filling formulation and a formula containing glycerol utilizing the same methods for examining heating rates of varying sugar concentrations.

To reduce the time needed to heat the pie, prevention of ice crystallization in the pie filling was reviewed. To lower the enthalpy of the pie filling and eliminate energy necessary to turn ice into water (latent heat), sodium alginate and glycerol are used for freezing point depression, which lower the temperature at which water freezes.

In frozen foods, it is difficult to separate latent heat and sensible heat because they contain water which is frozen at very low temperatures. The function of alginates is to prevent ice crystal formation and syneresis. To assure the prevention of ice crystallization, sodium alginate is used in the apple filling formulation to lower the filling enthalpy and eliminate the energy necessary for the phase change of water from solid to liquid. The preferential absorption of microwaves by liquid water over ice is a major cause for uneven heating and microwave penetration depth reduction. Preventing the formation of ice by using alginates greatly reduces these complications and maintains a quick evenly heated pie. In addition to this functionality, sodium alginate serves as a gelling agent, which brings the filling components together to create a desirable consistency.

In conjunction with the heating rate of the filling, the addition of these ingredients increases the density of the pie filling. With increased density of the pie filling, the absorption of the microwaves also increases, but with less penetration depth. In order to take advantage of increased absorption and reduce penetration depth, a structure was needed in the center of the food packaging. So the filling is placed around the ice cream food compartment. Therefore, the microwaves will not have to penetrate deeply into the filling of the pie to heat it to the appropriate temperature of 160° F. Susceptor films were used on both the food compartments to heat the pie at an even faster rate and create a browning effect on the top layer of crust. Thermal properties coupled with dielectric properties can have a synergistic effect on the rate of heating in the pie filling.

The proper filling mixed with a structure that separates the ice cream from the rest of the pie create the quick, food safe, and easy exemplary embodiment, "Minute Escape Apple Pie à la mode." A packaging process was designed to incorporate the design features.

Figure 9:
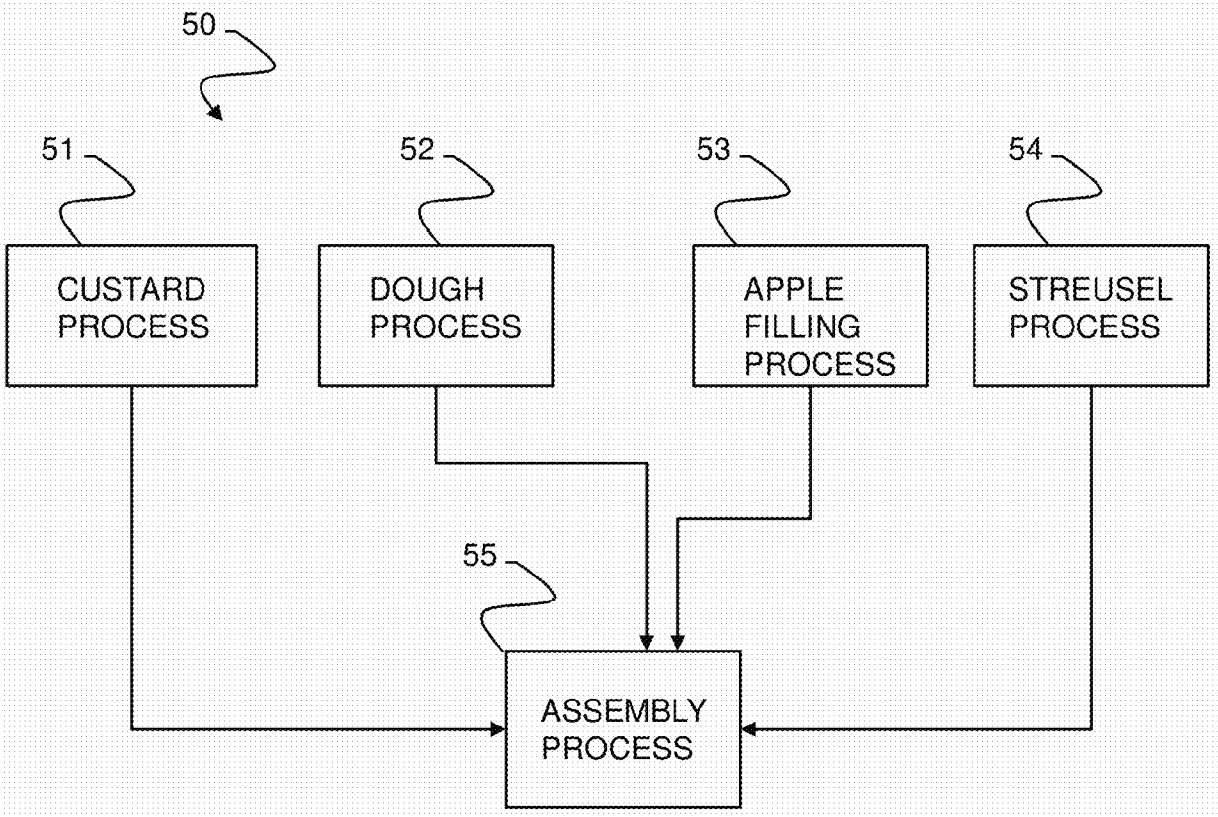
FIG. 9 is an exemplary embodiment of the invention through a process flow chart.

Referring to FIG. 9-14, a method 50 of processing and packaging a sample product is described. Referring to FIG. 9, the overview of a 5 step method 50 is shown. Steps 51-54, make up the component steps of the method 50, and the final step is the assembly step 55. Step 51 is the custard ice cream process (see FIG. 10). Step 52 is the dough process (see FIG. 11). Step 53 is the apple filling process (see FIG. 12). Step 54 is the streusel process (see FIG. 13). Step 55 is the assembly process (see FIG. 14).

Figure 10:
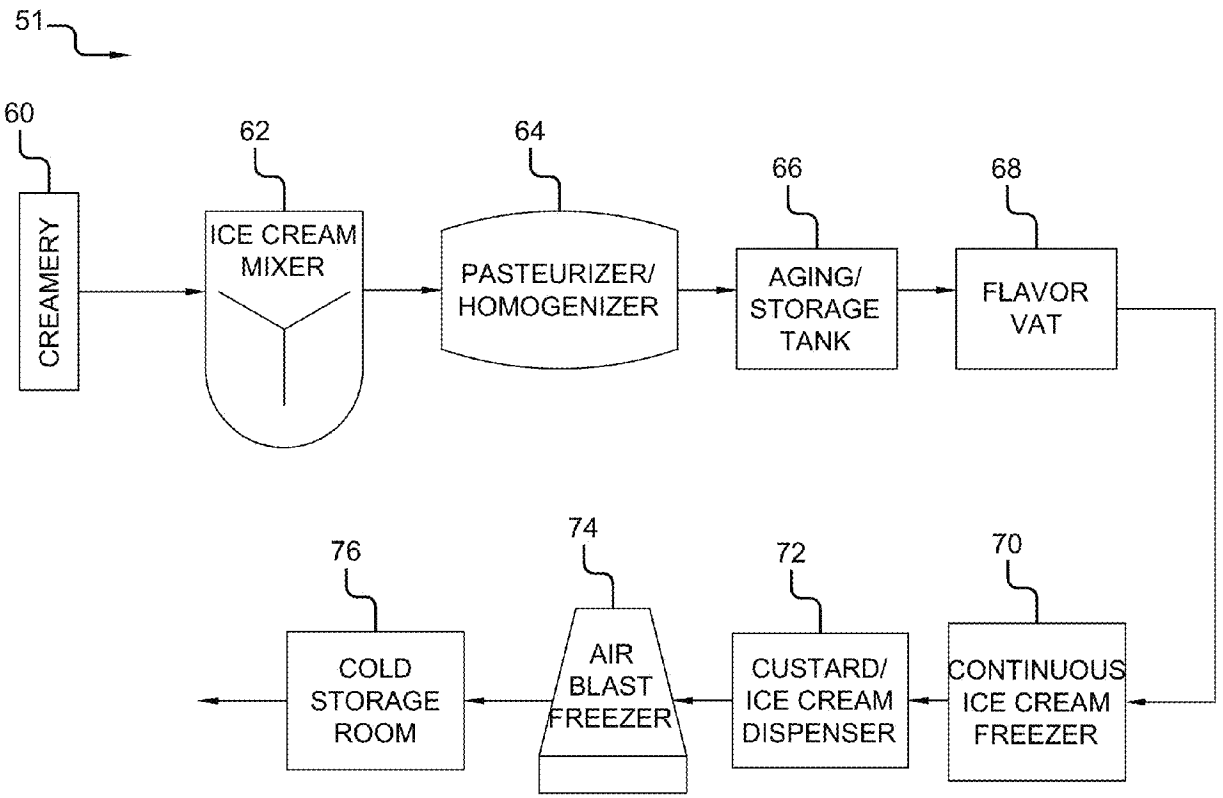
FIG. 10 is the custard ice cream processing flow chart.

Referring to FIG. 10, step 51 ice cream process flow chart is shown. Raw non fat milk is delivered to the creamery and placed into refrigerated holding tanks. In step 60, ingredients such as: heavy cream, water, granulated sugar, pasteurized frozen egg yolk, and non-fat dry milk are added to the ice cream mixer. In step 62, the ingredients are mixed and blended to make the ice cream mix. The ice cream mix in step 64 is then pasteurized at 180° F. for at least 25 seconds in a continuous plate heat exchanger system. Pasteurization ensures the ice cream is free of pathogens and step 64 is a quality check point to ensure ice cream meets government regulations. The mix is then homogenized in a two-stage system; the first stage is at 1500 psi and the second at 500 psi. This ensures a uniform dispersion of small fat globules. The ice cream mix is stored in an aging and storage tank in step 66 for 4 hours at 35° F. Flavoring is added in step 68. The ice cream mix is then pumped into a continuous barrel ice cream freezer in step 70, which adds filtered air to create an over-run of 80% while freezing into a soft consistency ice cream characterized by a temperature of 21° F. The incorporation of air (overrun) into the ice cream procedure lowers the overall thermal conductivity, thus preventing the rate at which heat transfer will occur through the ice cream and keeping it frozen longer. The air pocket insulation surrounding the ice cream cylinder helps protect the ice cream from freeze and thaw cycles. Stabilizers in the ice cream and filling also help to prevent an icy texture and to assure the expected shelf life. The ice cream is then pumped directly into the press-formed food compartments in step 72. The filled press formed food compartments proceed on a conveyor into an air blast freezer at −40° F. in step 74 and held in a hardening room at −10° F., in step 76, until the assembly.

Figure 11:
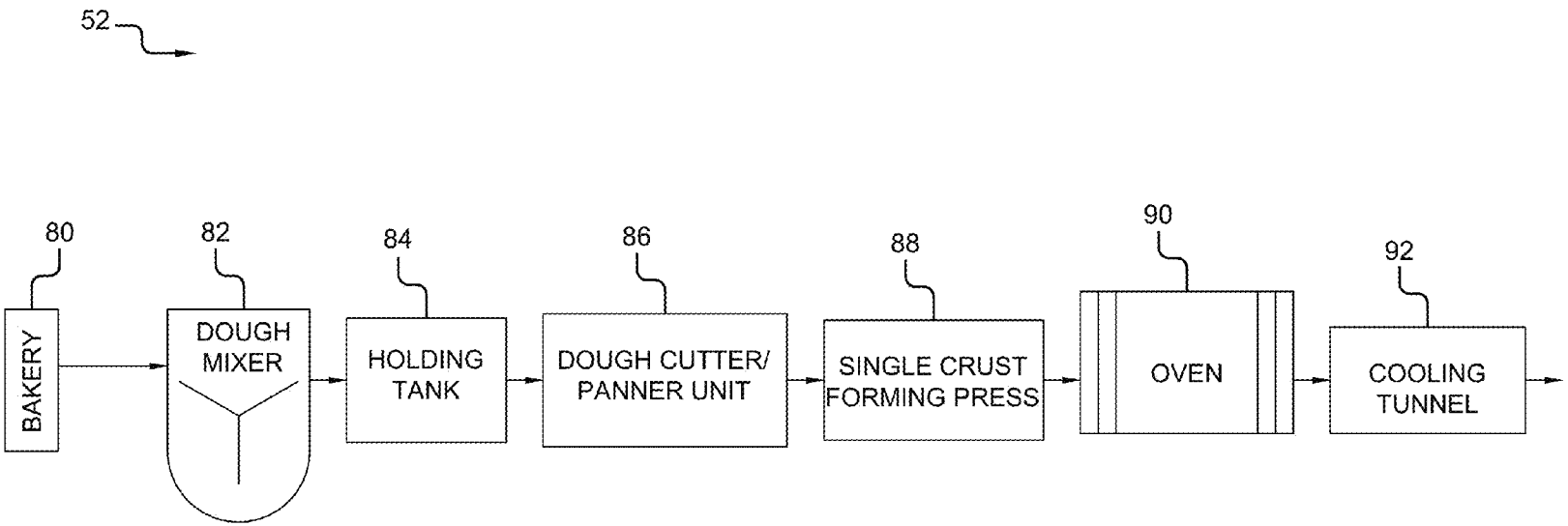
FIG. 11 is the dough processing flow chart.

Referring to FIG. 11, step 52 pie dough process is shown. In step 80, ingredients such as: enriched bleached wheat flour, partially hydrogenated vegetable shortening, water, and salt are added to the dough mixer. In step 82, the ingredients are mixed and blended for 3 minutes to make the pie dough mix. The dough is then stored in a holding tank at 40° F. for 30 minutes in step 84, before the dough is processed by the cutter. In step 86, the pre-made uncooked pie dough is cut into 2.1 oz. portions of dough and put into a food compartment. In step 88, the pie dough is pressed by an automated single crust forming press into a susceptor-lined press-formed food compartments and delivered to the processing plant. The pie dough and food compartment go through a conveyor oven at 350° F. for 10 minutes to fully cook the crust in step 90. This is regulated by a conveyor speed of 0.17 ft/s, and temperature is ensured as a quality checkpoint in the process. This quality check point ensures the internal temperature of the pie crust reaches 320° F. The pie crusts are then cooled in a cooling tunnel on the conveyor belt in step 92 to temperatures of 40° F.

Figure 12:
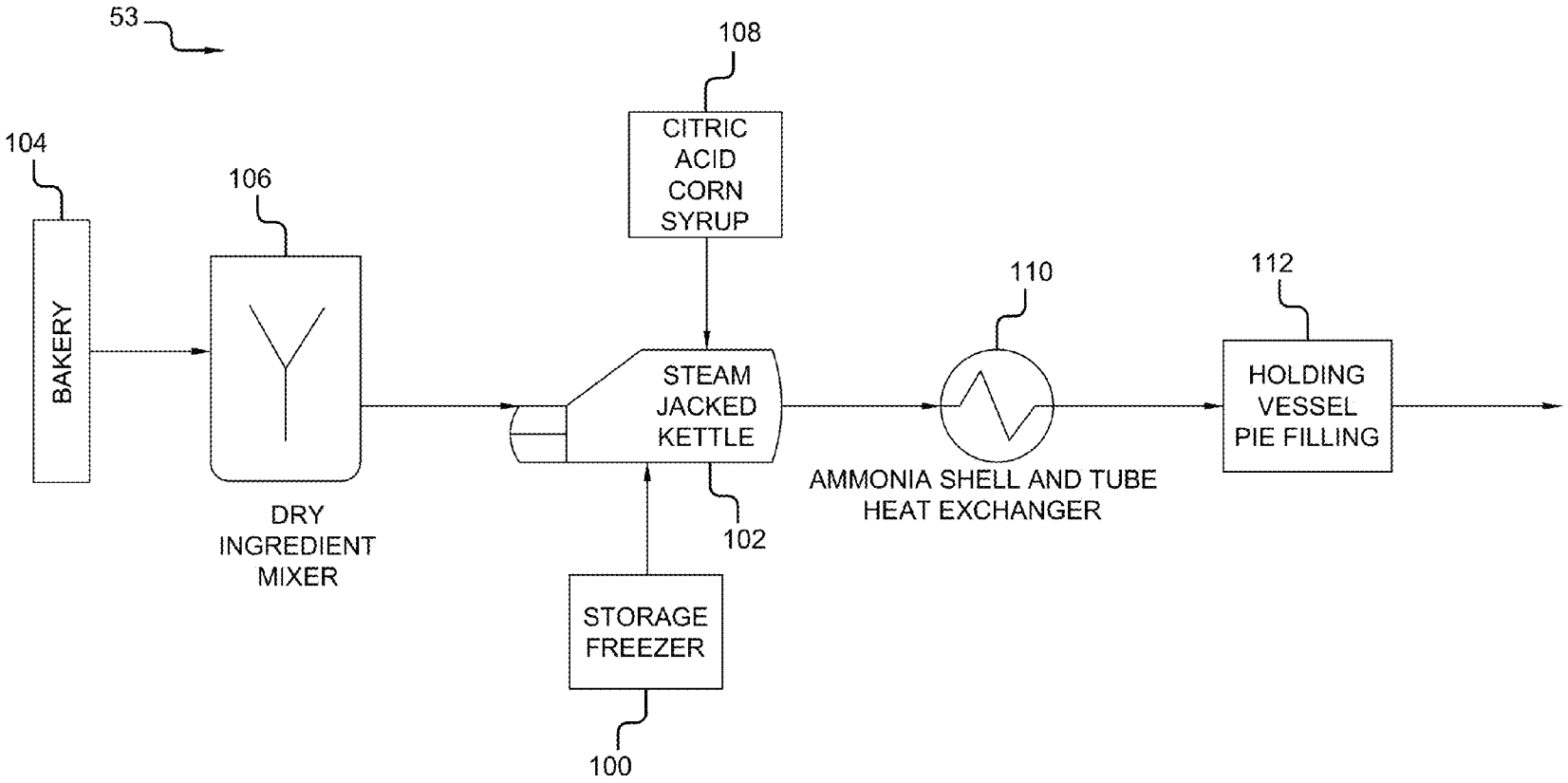
FIG. 12 is the apple filling processing flow chart.

Referring to FIG. 12, step 53 apple filling process is shown. Modified food starches used in the filling formulation increase the rate at which heat transfers due to the dielectric properties of the starch, as well as, increasing the thermal conductivity. In step 100, fresh-frozen apples are shipped to the assembly plant and stored in a walk in freezer at 0° F. before processing. Specifications require that apples are peeled, ¾" diced, and treated with citric acid. The apples are cooked for 5 minutes at 230° F. in a steam jacketed kettle with a stirring paddle to remove moisture in step 102. The apples in the filling are cooked to remove moisture and contain food gums which reduce the likelihood of ice crystal formation. Excess moisture in the filling can lead to ice crystallization, which increases the time required to cook in microwave. The apple filling is prepared utilizing a dry mix method. Brown and granulated sugar, modified food starch, cinnamon, and sodium alginate are added to a mixer to disperse particulates evenly in step 104. The dry mix and corn syrup are added to the apples in the same steam jacketed kettle and cooked for another 5 minutes while stirring in step 106.

To be consistent with the variability of the pH level of local apples used in the filling, citric acid is added. Citric acid in specific concentration will offset the natural pH level variations of the apples, maintaining a consistent product. Prior to addition of citric acid, a pH measurement of the filling is determined. Based on this measurement, the amount of citric acid necessary to reach the specified pH level of 3.7 to 3.8 is calculated and added to kettle in step 108. Due to the low pH level of the filling, the modified food starch used in the formulation to provide freeze/thaw stability is acid resistant. Utilizing an acid resistant starch will guarantee that the starch will not be broken down by the acid in the formula. In step 110, the mixture is then pumped through an ammonia shell and tube heat exchanger to cool to 40° F. In step 112, the filling is cooled, portioned into 50 lb. plastic buckets, refrigerated, and stored prior to delivering to the assembly plant.

Figure 13:
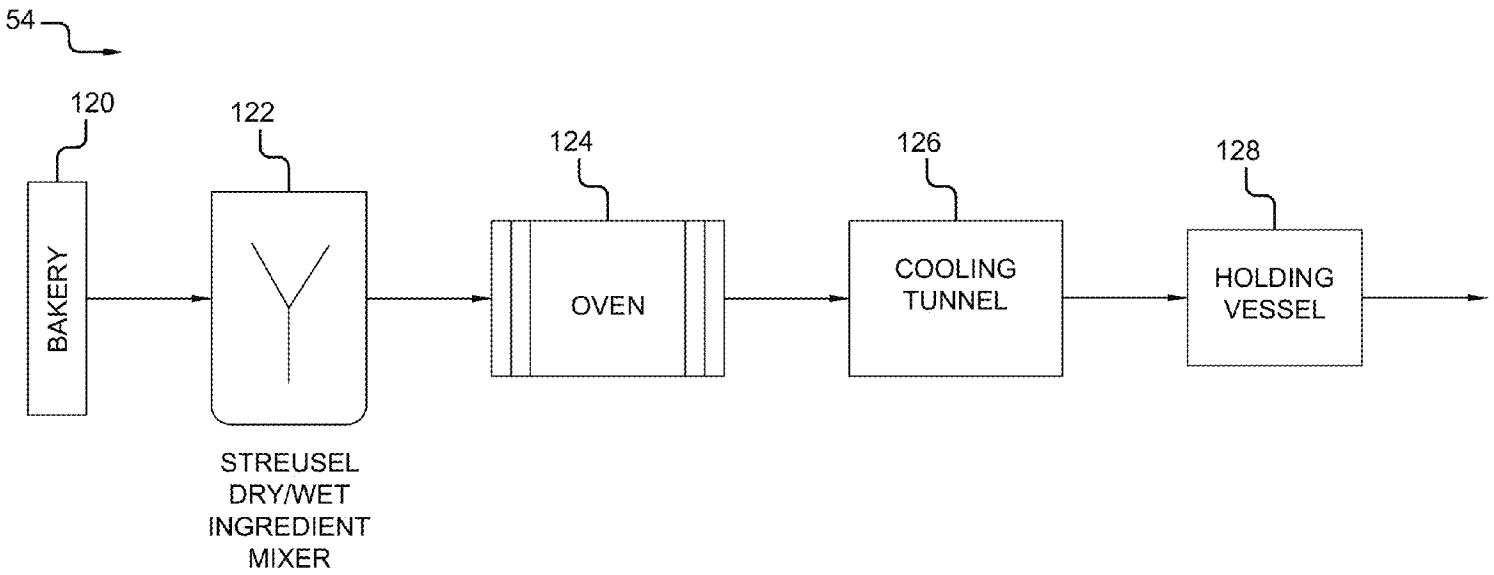
FIG. 13 is the streusel processing flow chart.

Referring to FIG. 13, step 54 streusel process is shown. The streusel is prepared as a batch process. In step 120, enriched bleached wheat flour, butter, instant rolled oats, brown sugar, salt, and cinnamon are placed into an industrial planetary mixer. In step 122, ingredients are mixed. In step 124, the streusel is spread onto the conveyer oven and baked at 350° F. for 8 minutes. This is regulated by a conveyor speed of 0.21 ft/s, and temperature is ensured as a checkpoint in the process. This check point ensures the internal temperature of the streusel reaches 320° F. The streusel is then cooled in a cooling tunnel in step 126, and in step 128, held at 40° F. until final product assembly.

Figure 14:
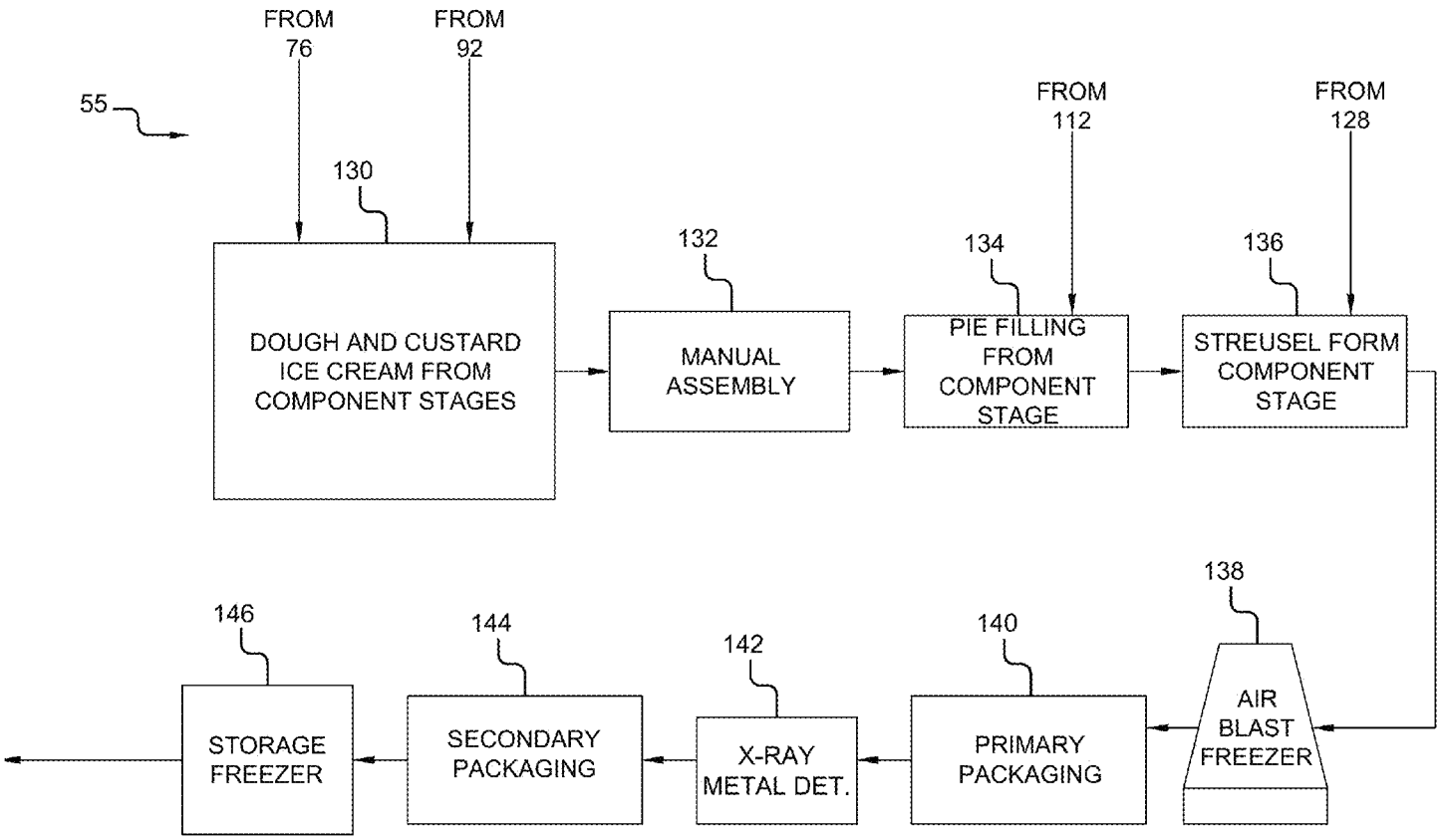
FIG. 14 is the assembly processing flow chart.

Referring to FIG. 14, step 55 assembly process is shown. In step 130, the cooled cooked crusts food compartments from step 76 and step 92 continue on a conveyor belt. In step 132, the ice cream susceptor food compartments are manually inverted and placed in the middle of the cooled cooked crusts food compartments. The outer food compartment has the susceptor surface in contact with the pie crust and the inner food compartment has the susceptor film, so that it is in contact with the filling and sits above the top layer of the apple pie streusel. The inner food compartment's angular walls form a cushion of air around the ice cream. The interior of the inner food compartment, which serves to contain the ice cream, is made of commercially available food-grade solid bleached sulphate (SBS). The SBS tube is formed and attached to the inner susceptor tray using non-toxic, water-resistant adhesive compliant with FDA standards for indirect food contact. In step 134, pie filling from step 112 is pumped through a depositor into the pie crust, surrounding the ice cream susceptor food compartment. In step 136, oatmeal streusel from step 128 is deposited over the pie by a topping unit. In step 138, the pies are rapidly frozen in an air blast freezer at −40° F. to prevent heat transfer between components. In step 140, the completed pies continue into a packaging system in which they are individually wrapped in individual plastic pouches made of 1.75 mil Low Density Poly Ethylene (LDPE), which provides a water barrier and protection against freezer burn.

In step 142, the completed pies passed through a metal and/or x-ray detector. This is the final quality check point. This check point insures that no metal fragments are detected, and if there are, then the food product is discarded. In step 144, the completed pies continue down the conveyor and are individually boxed and packaged in cases containing 24 units.

The food product uses a printed folding carton made of coated 100% recycled paperboard (food grade). The final dimensions of each individual retail carton are 6"×6"×2". Each retail carton will be identified with a label and barcode and a lot identification number for tracking purposes. A "packed on" date and "best before" date will be also be identified on the package as a measure of quality. Individual retail carton can be seen in FIG. 3 and FIG. 4. In step 146, thirty 24-count boxes are loaded onto pallets and stored in a holding freezer at −10° F. prior to shipping.

While exemplary methods and systems have been described herein, it should also be understood that the foregoing is only illustrative of the invention and its embodiments, as well as principles thereof, and that various modifications can be made by those skilled in the art without departing from its scope and spirit. Therefore, the described embodiments should not be considered as limiting of the invention in any way. Accordingly, the invention embraces alternatives, modifications and variations which fall within the spirit and scope of the embodiments described herein.

What is claimed is:

1. A microwave energy interactive structure for use during microwave cooking of a food product, the food product including a first food item and a second food item, the structure comprising:

a. a first food compartment having a first interior surface and a first exterior surface, the first interior surface forming a first cavity being adapted to receive the first food item, and having non-stick properties; and b. a second food compartment having a second interior surface forming a second cavity being adapted to receive the first food compartment, the second interior surface and the first exterior surface forming a sub cavity within the second cavity, the first exterior surface and the second interior surface being adapted to reflect microwave energy into the sub cavity.

2. The structure of claim 1, the first food compartment being further adapted to insulate the first food item from heat created by microwave energy.

3. The structure of claim 2, the second food compartment being further adapted to insulate the first food item from heat created by microwave energy on the second interior surface.

4. The structure of claim 1, the sub cavity being adapted to receive the second food item and completely enclosing the first food compartment.

5. The structure of claim 1, wherein the first food compartment includes at least one of: a layer of insulant material, a layer of non-stick material, and a layer of susceptive material.

6. The structure of claim 1, wherein the first food compartment and the second food compartment are cylindrical in shape.

7. The structure of claim 1 further comprises a wrap for sealing the second cavity.

8. The structure of claim 7, the second food compartment having an upper lip, the wrap being affixed to the second food compartment at the upper lip.

9. The structure of claim 1, wherein the first food compartment having an upper edge extending above a top layer of the second food item and being adapted to reflect microwave energy onto the top layer of the second food item.

10. The structure of claim 1, wherein the first food item is ice cream.

11. The structure of claim 1, wherein the second food item is apple pie.

12. A microwave energy interactive structure for use during microwave cooking of a food product, the food product including a first food item and a second food item, the structure comprising:

a. a first food compartment having a first interior surface and a first exterior surface, the first interior surface forming a first cavity being adapted to receive the first food item, and having non-stick properties;

b. a second food compartment having a second interior surface forming a second cavity being adapted to receive the first food compartment, the second interior surface and the first exterior surface forming a sub cavity within the second cavity, the first exterior surface and the second interior surface being adapted to reflect microwave energy into the sub cavity;

c. a wrap for sealing the second cavity, the first food compartment being adapted to insulate the first food item from heat resulting from microwave energy.

13. The structure of claim 12, the second food compartment being further adapted to insulate the first food item from heat created by microwave energy on the second interior surface.

14. The structure of claim 12, the sub cavity being adapted to receive the second food item and completely enclosing the first food compartment.

15. The structure of claim 12, wherein the first food compartment includes at least one of: a layer of insulant material, a layer of non-stick material, and a layer of susceptive material.

16. The structure of claim 12, wherein the first food compartment and the second food compartment are cylindrical in shape.

17. The structure of claim 12 further comprises a wrap for sealing the second cavity.

18. The structure of claim 17, the second food compartment having an upper lip, the wrap being affixed to the second food compartment at the upper lip.

19. The structure of claim 12, wherein the first food compartment having an upper edge extending above a top layer of the second food item and being adapted to reflect microwave energy onto the top layer of the second food item.

20. The structure of claim 12, wherein the first food item is ice cream.

21. The structure of claim 12, wherein the second food item is apple pie.

22. A microwave energy interactive structure for use during microwave cooking of a food product, the food product including a first food item and a second food item, the structure comprising:

a. a first food compartment having a first interior surface and a first exterior surface, the first interior surface forming a first cavity being adapted to receive the first food item, and having non-stick properties;

b. a second food compartment having a second interior surface forming a second cavity being adapted to receive the first food compartment, the second interior surface and the first exterior surface forming a sub cavity within the second cavity, the sub cavity being adapted to receive the second food item, the second food item completely enclosing the first food compartment, the first exterior surface and the second interior surface being adapted to reflect microwave energy into the sub cavity; and c. a wrap for sealing the second cavity, the first food compartment being adapted to insulate the first food item from heat resulting from microwave energy, the first food compartment having an upper edge extending above a top layer of the second food item and being adapted to reflect microwave energy onto the top layer of the second food item.

* * * * *